US005989307A

United States Patent [19]

den Hartog

[11] Patent Number: 5,989,307

[45] Date of Patent: Nov. 23, 1999

[54] METHOD AND APPARATUS FOR PRODUCING PIG IRON BY SMELTING REDUCTION AND METHOD OF OBTAINING SUCH A PLANT

[75] Inventor: Huibert W. den Hartog, Noordwijkerhout, Netherlands

[73] Assignee: Hoogovens Staal B.V., Ijmuiden, Netherlands

[21] Appl. No.: 09/170,073

[22] Filed: Oct. 13, 1998

Related U.S. Application Data

[63] Continuation of application No. 08/679,901, Jul. 15, 1996, Pat. No. 5,827,473.

[30] Foreign Application Priority Data

Jul. 19, 1995 [NL] Netherlands ..... 1000838

[51] Int. Cl.[6] ..... C21B 7/00

[52] U.S. Cl. ..... 75/433; 266/DIG. 1

[58] Field of Search ..... 266/44, 192, 156, 266/DIG. 1; 75/433

[56] References Cited

U.S. PATENT DOCUMENTS

| | | | |
|---|---|---|---|
| 4,179,284 | 12/1979 | Weigel et al. | 75/92 |
| 4,223,876 | 9/1980 | Weigel et al. | 266/156 |
| 5,662,860 | 9/1997 | Klaassen et al. | 266/158 |
| 5,800,592 | 9/1998 | Den Hartog et al. | 75/453 |
| 5,827,473 | 10/1998 | Den Hartog | 266/44 |

FOREIGN PATENT DOCUMENTS

| | | |
|---|---|---|
| 3720648 | 1/1989 | Germany . |
| 3608150 | 7/1989 | Germany . |
| 87961 | 6/1991 | Luxembourg . |

OTHER PUBLICATIONS

*European Search Report, Apr. 11, 1996 (to the extent of relevance).

"Direct smelting in an experimental cyclone converter furnace," Steel Times Incorporating Iron & Steel, 221 May 1993, No. 5.

English abstract of Japanese 7090335 dated Apr. 4, 1995.

*Primary Examiner*—Scott Kastler

*Attorney, Agent, or Firm*—Stevens, Davis, Miller & Mosher, L.L.P.

[57] ABSTRACT

A plant for a smelting reduction process for pig iron production using coal and oxygen-containing gas is obtained by converting an existing blast furnace plant by replacing the blast furnace by apparatus including at least one metallurgical vessel for carrying out the smelting reduction process, while retaining at least partly at least one of the following components of the existing blast furnace plant:

i) storage bins for iron ore ii) storage bins for coke, as storage bins for coal iii) a casting house, for tapping of the metallurgical vessel iv) a gas discharge system for hot gas including dedusting means, v) a cooling water supply system.

11 Claims, 1 Drawing Sheet

METHOD AND APPARATUS FOR PRODUCING PIG IRON BY SMELTING REDUCTION AND METHOD OF OBTAINING SUCH A PLANT

This application is a continuation of U.S. patent application Ser. No. 08/679,901, filed Jul. 15, 1996, now U.S. Pat. No. 5,827,473.

FIELD OF THE INVENTION

The invention relates to a method of obtaining a plant for the production of pig iron from iron oxides by a smelting reduction process in which iron oxides are reduced by means of coal and oxygen-containing gas. The invention also relates to the plant obtained by the method and to a method of producing pig iron carried out in such a plant.

DESCRIPTION OF THE PRIOR ART

For years pig iron has been produced using the known blast furnace process in a blast furnace in which iron oxides in agglomerated form such as sinter or pellets are reduced essentially with the aid of coke and hot blast (air). The blast furnace is a metallurgical vessel forming part of a substantial blast furnace plant including for example storage bins for iron ore and for coke, a skip hoist for supplying iron ore and coke into the blast furnace, hot-blast stoves, a cast house with means for tapping off pig iron and slag, a blast furnace gas discharge system with dedusting and a cooling water system for cooling the refractory lining of the blast furnace. Coke is made in a coking plant from coal by dry distillation at approximately 1,000° C. This makes the volatile constituents escape from the coal and produces coke which provides a sturdy, porous structure in the blast furnace. Making coke is costly and environmentally harmful.

A modern blast furnace usually has a hearth diameter of 12 to 14 m, a production of 3 to 4 million tons of pig iron per annum and when newly built requires an investment of FL 1 billion (approximately US$600 million).

A blast furnace is run continuously during a working campaign which, for a blast furnace with a modern refractory lining, can last for over 10 years, the end being determined by the need to replace the refractory lining. At the end of the working term the blast furnace is shut down and repaired (relined).

In various places in the world work has been continuing for some decades on developing alternative processes for producing pig iron by smelting reduction in which iron oxides are reduced essentially with coal and oxygen or oxygen-containing gas. In specialist literature such processes are known by the names (trademarks) AISI Direct Ironmaking, CCF, Corex, DIOS and Hismelt. The advantage of these processes is that no coke is needed for the production of pig iron and that in some of the processes, namely CCF, DIOS and Hismelt, the process of preparing ore by agglomeration (pelletizing) may be omitted. AISI Direct Ironmaking, CCF and DIOS are so-called molten slag bath reduction processes in which the final reduction of the iron ore takes place in a slag layer floating on the liquid pig iron. The CCF process is described in EP-A-690136, EP-A-686703 and European patent applications 96200246.5 and 96200774.6 to be published soon, to which reference should be made for details. Hismelt is a so-called molten iron bath reduction process.

To date only the Corex process has been used on an industrial scale. However, the process has a high coal consumption and produces much gas.

Although promising results have been attained from the development of the other processes named, to date there has been no breakthrough towards industrial application partly because the investment cost of an installation for these processes is not significantly less than that for a blast furnace installation and because the cost price of the pig iron is not less than with a blast furnace.

Experimental work on the CCF process is described in "Steel Times" (published in UK), May 1993, page 220. In a first attempt at direct smelting of iron ore a blast furnace was converted for direct reduction trials, using coal instead of coke, but the iron ore was in agglomerated form. To avoid the need for agglomerated ore, a new furnace known as a cyclone and converter furnace (CCF) was designed, having a full reduction vessel, similar to a converter in shape, as its lower part and a cyclone reactor mounted immediately above it. Ore is pre-reduced in the cyclone reactor by a reducing process gas originating in the lower vessel. In the lower vessel, the ore is finally reduced by means of coal and oxygen. The oxygen effects post-combustion of the gas in the lower vessel to provide heat.

It is mentioned also that DE-A-3608150 and DE-A-3720648 describe processes and vessels for direct reduction of oxides. In particular, DE-A-3720648 proposes adaptation of a blast furnace by adding apertures for air injection at two levels.

SUMMARY OF THE INVENTION

The object of the invention is to provide a method of obtaining a plant, and a plant and a method, for producing pig iron by smelting reduction with a lower investment cost and a lower cost price of the pig iron than with a blast furnace.

According to the invention in one aspect, there is provided a method of obtaining a plant for a smelting reduction process for pig iron production in which iron oxides are reduced by means of coal and oxygen-containing gas, comprising the step of converting an existing blast furnace plant into the plant for the smelting reduction process by replacing the blast furnace in the blast furnace plant by apparatus including at least one metallurgical vessel suitable for carrying out the smelting reduction process, while retaining at least partly at least one of the following components of the existing blast furnace plant:

i) storage bins for iron ore to be supplied to the metallurgical vessel, ii) storage bins for coke, as storage bins for coal to be supplied to the metallurgical vessel, iii) a casting house having means for tapping off pig iron and slag, for tapping of the metallurgical vessel, iv) a gas discharge system for hot gas from the blast furnace including dedusting means, for handling of the discharge gas from the smelting reduction process, and v) a cooling water supply system for the blast furnace, as a cooling water supply system for the metallurgical vessel.

Any combination of two or more of the above components of the existing blast furnace plant may be retained in the new plant.

In another aspect the invention provides a plant obtained by the above method of the invention.

The invention further consists in a method of producing pig iron, using coal and oxygen-containing gas, in a plant obtained by the above method of the invention.

Preferably in the invention the smelting reduction process is of a type comprising a pre-reduction process of iron oxides using a reducing process gas and a final reduction process of the pre-reduced iron oxides, in which the pre-reduced iron oxides are finally reduced in a final reduction vessel primarily with the aid of coal and oxygen in which the reducing process gas originates. More preferably, in the final reduction vessel in which the final reduction process takes place a production rate of pig iron is applied per unit of cross-sectional area of the final reduction vessel in the range 40–120 ton/$m^2$/24 h. AISI Direct Ironmaking, CCF, DIOS and Hismelt are suitable for this. The Corex process has a lower production rate. For these processes the average vertical flow rate of the process gas across the empty internal cross-section of the final reduction vessel is for example 1–5 m/s.

Preferably the production rate of pig iron in the final reduction vessel, which is used in place of the blast furnace, is at least equal to the production rate of the blast furnace relative to the hearth cross-section of the blast furnace and is greater than 60 ton/$m^2$/24 h. AISI Direct Ironmaking, CCF, and DIOS are suitable for this. In terms of design of the final reduction vessel, the Hismelt process is less suitable to be used in the place of a blast furnace.

Preferably a pre-reduction process of the iron oxides is applied in a smelting cyclone in which, with oxygen being supplied, a combustion is maintained in the reducing process gas (the CCF process). The CCF process is particularly suitable due to the compactness of the pre-reduction. The DIOS and AISI Direct Ironmaking process are less suitable due to the size and complexity of their pre-reduction which is probably less easy to accommodate in a blast furnace installation.

The applicants arrived at the view that surprisingly, in terms of production rate, the blast furnace process and the smelting reduction process are to a certain extent compatible and that significant advantages may be obtained by converting a blast furnace installation for smelting reduction. The conversion may take place at the end of a working term of the blast furnace or earlier.

With a somewhat equivalent production rate, the supply quantities of iron ore and coal or coke and the installation parts for storing and supplying them are also compatible. The installation parts for discharging pig iron, slag and process gas are also compatible.

With this invention a significantly lower cost price of up to FL 50.00 (approximately US$30.00) per ton of pig iron lower than with the blast furnace process can be obtained without coke and using certain smelting reduction processes without pellets for a very low investment cost which is comparable to the costs of furnace repair.

Preferably the pressure in the final reduction vessel is in the range 1–5 atmospheres. This pressure is suitably chosen in dependence on the desired production rate. In this manner in certain cases the production rate of the smelting process can be made to be virtually the same as that of the blast furnace so that both processes and installations are virtually fully compatible.

Preferably the actual production rate of pig iron is maintained lower than the production rate of pig iron having the lowest possible coal consumption per ton of pig iron produced in the plant being used, and the actual production rate of the reducing process gas is increased relative to the production rate thereof corresponding to this production rate of pig iron having the lowest possible coal consumption. Thus, the actual production rate of pig iron may be lower than the production rate of pig iron having the lowest possible coal consumption by 0 to 30%, and the actual production rate of the reducing process gas may be higher than the production rate thereof corresponding to the production rate of pig iron having the lowest possible coal consumption by 0 to 30%.

With a blast furnace the aim is to achieve by all kinds of means such as coal-dust injection the lowest possible coke consumption because coke is a costly raw material. However, a minimum quantity of 300 kg coke/ton of pig iron is needed for the blast furnace process. With smelting reduction processes and in particular with the CCF process there is the possibility to increase the coal consumption relative to a minimum coal consumption of 500–640 kg/ton (coal gasification). This reduces the production rate and increases the quantity and energy content of the process gas leaving the smelting reduction installation, which process gas can be used for generating energy.

As indicated above, preferably the metallurgical vessel which replaces the blast furnace comprises a final reduction vessel and a smelting cyclone directly above the final reduction vessel and in open communication with it.

Where the blast furnace plant includes a steel structure around the blast furnace, the metallurgical vessel is preferably installed within the steel structure which is retained. If the apparatus for carrying out the smelting reduction includes a boiler, in which water is heated by the discharge gas from the smelting reduction process, the boiler may also be installed within the steel structure.

The metallurgical vessel may thus comprise a final reduction vessel having a characterizing greatest diameter which is not greater than the characterizing greatest diameter of said blast furnace which is replaced.

In this way, the work of conversion of the blast furnace plant can be made not very extensive, and investment cost can be kept low.

Depending on the particular smelting reduction process used in the invention, the oxygen-containing gas may be air, oxygen-enriched air or oxygen. For the CCF process, oxygen is required, which may be obtained by the addition of an oxygen-making apparatus during the conversion of the blast furnace plant. Oxygen is used in the manufacture of steel, so that an iron and steel works already has oxygen-making capacity, but the strict requirement for low nitrogen content in the oxygen for steel-making does not apply to the pig iron production by the CCF process. Therefore a lower grade oxygen-making installation may conveniently be added to the blast furnace plant being converted in accordance with the invention.

Thus where the oxygen-containing gas is oxygen, and the metallurgical vessel comprises a final reduction vessel and a smelting cyclone to which the oxygen is fed, the method of conversion may include adding an oxygen-producing plant to the existing blast furnace installation.

INTRODUCTION OF THE DRAWING

One embodiment of the invention will now be described by way of non-limitative example and with is reference to the drawing in which FIG. 1 is a schematic and diagrammatic side view of a pig iron producing plant embodying the invention.

DESCRIPTION OF THE PREFERRED EMBODIMENT

Figure 1:
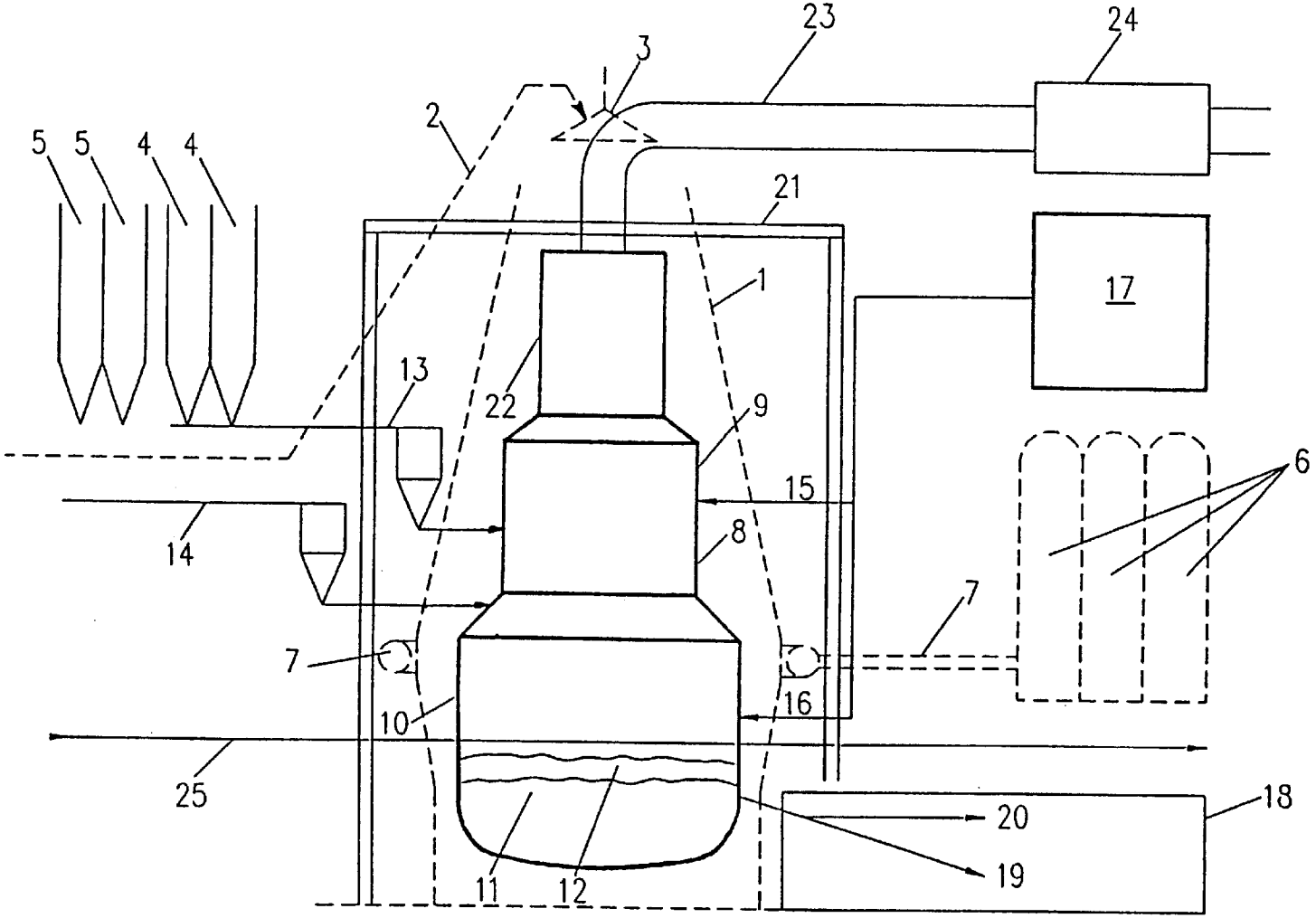

FIG. 1 shows schematically the situation following conversion of an existing blast furnace plant, wherein, for the production of pig iron, the blast furnace process is replaced by the CCF process of smelting reduction. However, the invention is not limited to this smelting reduction process and applies also to other smelting reduction processes, such as those discussed above. Dotted lines in FIG. 1 indicate those parts of the existing blast furnace plant which are no longer needed following conversion and are removed. New plant parts added in the conversion are shown in bold.

In the existing plant, the blast furnace 1 is supplied, via a skip hoist 2 and a bell 3, with iron ore in the form of sinter or pellets from stockhouse storage bins 4 and with coke from stockhouse storage bins 5. Hot blast (air) is supplied from hot blast stoves 6 and via hot blast main 7. In the conversion the blast furnace 1 is replaced by a metallurgical vessel 8 for the smelting reduction of iron compounds. FIG. 1 shows that this vessel for the smelting reduction is of the CCF type (Cyclone Converter Furnace), having a cyclone reactor 9 in which the pre-reduction and the smelting of the iron oxides takes place and a final reduction vessel 10 in which there is a pig iron melt 11 with a slag layer 12 floating on top of it. The cyclone reactor 9 is immediately above the final reduction vessel 10, to form a single unit, and the two are in direct open communication with each other.

Iron oxides are supplied from the stockhouse bin 4 via a feed system 13 to the cyclone reactor 9 of the CCF vessel 8. These iron oxides can comprise both iron ore conglomerate and blast furnace dust or converter dust. In the case of a CCF process the iron ore may be supplied unagglomerated.

Coal is supplied from the stockhouse bins 5 via a feed system 14 to the final reduction vessel 10. Oxygen is fed via feed line 15 to the cyclone reactor 9 and via feed line 16 to the final reduction vessel 10, both supplies originating from the new oxygen plant 17.

Big advantages of the invention in investment cost are obtained because, following the conversion, use continues to be made of many parts of the existing blast furnace plant, which may not require much adaptation. Retained from the existing plant in this case are the cast house 18 with its means for tapping off pig iron 19 and slag 20, and the cooling water supply system 25 now adapted for cooling the cyclone 9 and the final reduction vessel 10, as well as the storage bins 4,5. Furthermore, the cyclone 9 and the final reduction vessel 10 are installed within the steel structure 21 of the original blast furnace 1. The process gas generated during the direct reduction is discharged at a temperature of 1,400° C. to 1,800° C. from the cyclone via a new water-heating boiler 22, and via the existing blast furnace gas discharge system 23 with dedusting means 24.

What is claimed is:

1. A method of producing pig iron comprising, providing a plant for a smelting reduction process for pig iron production in which iron oxides are reduced by means of coal and oxygen-containing gas from a blast furnace plant which includes a steel structure, a storage bin for iron oxide-containing iron ore, a storage bin for coke, a casting house with means for tapping off pig iron and slag, a gas discharge system for hot gas including dedusting means, and a cooling water supply system;

positioning a metallurgical vessel suitable for carrying out said smelting reduction process within said steel structure and connecting thereto at least one of:

i) said storage bin for iron ore, ii) said storage bin for coke, as a storage bin for coal, iii) said casting house, for tapping of said metallurgical vessel, iv) said gas discharge system, for handling of the discharge gas from said smelting reduction process, and v) said cooling water supply system, as a cooling water supply system for said metallurgical vessel;

feeding said coal, iron ore and oxygen-containing gas to said metallurgical vessel at smelting reduction conditions; and at least one step selected from the group consisting of:

passing said iron ore from said storage bin for iron ore to said metallurgical vessel;

passing said coal from said storage bin for coke to said metallurgical vessel;

tapping of pig iron and slag from said metallurgical vessel into said casting house;

discharging hot gas from said metallurgical vessel into said gas discharge system; and supplying cooling water to said metallurgical vessel from said cooling water supply system.

2. A method of producing pig iron according to claim 1, wherein said metallurgical vessel of said plant comprises a final reduction vessel and said smelting reduction comprises the steps of (a) performing a pre-reduction of said iron oxides by means of a reducing process gas obtained in step (b) below, and (b) performing a final reduction of pre-reduced oxides from step (a), said final reduction being carried out in said final reduction vessel to which coal and oxygen are fed and in which said reducing process gas is produced.

3. A method of producing pig iron according to claim 2 wherein in said final reduction vessel said final reduction of step (b) has a production rate of pig iron, per unit of cross-sectional area of said final reduction vessel, in the range 40 to 120 ton/$m^2$/hour.

4. A method of producing pig iron according to claim 2 wherein said metallurgical vessel of said plant comprises, in addition to said final reduction vessel, a smelting cyclone, said pre-reduction of step (a) being carried out in said smelting cyclone with supply of oxygen thereto so that a combustion is maintained in said reducing process gas.

5. A method of producing pig iron according to claim 2 wherein a pressure in the range 1 to 5 atmospheres is maintained in said final reduction vessel.

6. A method of producing pig iron according to claim 1, wherein the actual production rate of pig iron is maintained lower than the production rate of pig iron having the lowest possible coal consumption per ton of pig iron produced, and the actual production rate of said reducing process gas is increased relative to the production rate thereof corresponding to said production rate of pig iron having the lowest possible coal consumption.

7. A method according to claim 6 wherein said actual production rate of pig iron is lower than said production rate of pig iron having the lowest possible coal consumption by 0 to 30%, and said actual production rate of said reducing process gas is higher than said production rate thereof corresponding to said production rate of pig iron having the lowest possible coal consumption by 0 to 30%.

8. A method of producing pig iron comprising:

providing a plant for carrying out a smelting reduction process for pig iron production in which iron oxides are reduced by means of coal and oxygen-containing gas, by converting a blast furnace plant into said plant for carrying out said smelting reduction process, said plant for the smelting reduction process comprising a steel structure from said blast furnace, a metallurgical vessel suitable for carrying out said smelting reduction process positioned within said steel structure, and at least one of:

i) storage bins for iron oxide-containing iron ores, ii) storage bins for coke, as storage bins for coals, iii) a casting house having means for tapping off pig iron and slag, for tapping of said metallurgical vessel, iv) a gas discharge system for hot gas from the blast furnace including dedusting means, for handling of the discharge gas from said smelting reduction process, and v) a cooling water supply system for said blast furnace, as a cooling water supply system for said metallurgical vessel;

feeding said coal, iron oxides and oxygen-containing gas to said metallurgical vessel at smelting reduction conditions; and at least one step selected from the group consisting of:

passing said iron ore from said storage bin for iron ore to said metallurgical vessel;

passing said coal from said storage bin for coke to said metallurgical vessel;

tapping of pig iron and slag from said metallurgical vessel into said casting house;

discharging hot gas from said metallurgical vessel into said gas discharge system; and supplying cooling water to said metallurgical vessel from said cooling water supply system.

9. The process of claim 8, wherein said iron oxides are unagglomerated.

10. The process of claim 8, wherein said metallurgical vessel comprises a final reduction vessel and a smelting cyclone directly above said final reduction vessel and in open communication therewith.

11. The process of claim 1, wherein said iron oxides are unagglomerated.

* * * * *